US009446825B1

(12) United States Patent
Gallagher

(10) Patent No.: US 9,446,825 B1
(45) Date of Patent: Sep. 20, 2016

(54) SELF-PROPELLED, CATAMARAN-TYPE, DUAL-APPLICATION, SEMISUBMERSIBLE SHIP WITH HYDRODYNAMIC HULLS AND COLUMNS

(71) Applicant: Hugh Francis Gallagher, Lakeway, TX (US)

(72) Inventor: Hugh Francis Gallagher, Lakeway, TX (US)

( * ) Notice: Subject to any disclaimer, the term of this patent is extended or adjusted under 35 U.S.C. 154(b) by 0 days.

(21) Appl. No.: 14/566,484

(22) Filed: Dec. 10, 2014

Related U.S. Application Data

(60) Provisional application No. 61/914,209, filed on Dec. 10, 2013.

(51) Int. Cl.

| | |
|---|---|
| ***B65D 88/78*** | (2006.01) |
| ***B63C 7/00*** | (2006.01) |
| ***B63B 29/02*** | (2006.01) |
| ***B63B 1/10*** | (2006.01) |
| ***B63B 1/12*** | (2006.01) |
| ***F16L 1/14*** | (2006.01) |
| ***B63B 35/44*** | (2006.01) |
| ***B63B 35/03*** | (2006.01) |

(52) U.S. Cl.
CPC ..... *B63C 7/00* (2013.01); *B63B 1/107* (2013.01); *B63B 1/121* (2013.01); *B63B 29/02* (2013.01); *B63B 35/03* (2013.01); *B63B 35/4413* (2013.01); *F16L 1/14* (2013.01)

(58) Field of Classification Search
CPC ..... B63B 29/02; B63B 1/107; B63B 1/121; B63B 2001/121; B63B 2001/123; B63B 35/03; B63B 35/4413; B63B 2035/44; B63B 2035/442; B63B 2035/4486; B63C 7/00; F16L 1/14
USPC ..... 114/256, 50, 51
See application file for complete search history.

(56) References Cited

U.S. PATENT DOCUMENTS

| | | | | |
|---|---|---|---|---|
| D197,868 | S | 3/1964 | Thornton | |
| 3,616,773 | A | 11/1971 | Lloyd | |
| 3,653,354 | A | 4/1972 | Pangalila | |
| 3,673,974 | A | 7/1972 | Harper | |
| 3,763,809 | A | 10/1973 | Pazos | |
| 3,771,481 | A | 11/1973 | Goren et al. | |
| 3,835,800 | A | 9/1974 | Lloyd et al. | |
| 3,857,352 | A | 12/1974 | Schott | |
| 3,946,684 | A * | 3/1976 | Sumner | E02B 17/021 114/265 |
| RE29,167 | E | 4/1977 | Lloyd | |
| RE29,478 | E | 11/1977 | Goren et al. | |
| 4,091,760 | A | 5/1978 | Lloyd | |
| 4,150,635 | A | 4/1979 | Lloyd et al. | |
| 4,165,702 | A | 8/1979 | Lloyd et al. | |
| 4,166,426 | A | 9/1979 | Lloyd | |
| 4,257,718 | A | 3/1981 | Rosa et al. | |
| 4,273,067 | A | 6/1981 | Lloyd et al. | |
| 4,281,615 | A | 8/1981 | Wilson et al. | |
| 4,312,287 | A * | 1/1982 | Kuo | B63B 27/02 114/259 |

(Continued)

*Primary Examiner* — Daniel V Venne
(74) *Attorney, Agent, or Firm* — David S. Alavi

(57) ABSTRACT

A semisubmersible vessel can comprise: a first hull, one or more columns extending upward from the first hull, a second hull, one or more columns extending upward from the second hull, and one or more cross members joining the first hull or its columns and the second hull or its columns. The first and second hulls are shaped to reduce hydrodynamic drag; the one or more columns can also be shaped to reduce hydrodynamic drag. The hulls include one or more self-propulsion units mounted at various locations for various purposes (e.g., cruising, maneuvering, station-keeping, and so on).

13 Claims, 15 Drawing Sheets

(56) References Cited

U.S. PATENT DOCUMENTS

| | | | | |
|---|---|---|---|---|
| 4,436,050 | A | 3/1984 | Liden | |
| 4,471,708 | A | 9/1984 | Wilson et al. | |
| 4,646,672 | A | 3/1987 | Bennett et al. | |
| 4,690,086 | A * | 9/1987 | McKenna | B63B 1/14 114/123 |
| 4,899,682 | A | 2/1990 | Pouget et al. | |
| 4,909,174 | A | 3/1990 | Bowes | |
| 5,038,702 | A | 8/1991 | Bowes | |
| 5,607,260 | A | 3/1997 | Khachaturian | |
| 5,609,441 | A | 3/1997 | Khachaturian | |
| 5,662,434 | A | 9/1997 | Khachaturian | |
| 5,800,093 | A | 9/1998 | Khachaturian | |
| 5,975,807 | A | 11/1999 | Khachaturian | |
| 6,039,506 | A | 3/2000 | Khachaturian | |
| 6,149,350 | A | 11/2000 | Khachaturian | |
| 6,247,421 | B1 | 6/2001 | Ludwigson | |
| 6,260,502 | B1 * | 7/2001 | Kratz | B63B 1/107 114/264 |
| 6,318,931 | B1 | 11/2001 | Khachaturian | |
| 6,364,574 | B1 | 4/2002 | Khachaturian | |
| 6,367,399 | B1 | 4/2002 | Khachaturian | |
| 6,378,450 | B1 | 4/2002 | Begnaud et al. | |
| 6,425,710 | B1 | 7/2002 | Khachaturian | |
| 6,435,773 | B1 | 8/2002 | Khachaturian | |
| 6,435,774 | B1 | 8/2002 | Khachaturian | |
| 6,524,049 | B1 | 2/2003 | Minnes | |
| 6,668,747 | B2 | 12/2003 | Kjerstad | |
| 6,692,190 | B2 | 2/2004 | Khachaturian | |
| 6,719,495 | B2 | 4/2004 | Khachaturian | |
| 7,527,006 | B2 | 5/2009 | Khachaturian | |
| 7,845,296 | B1 | 12/2010 | Khachaturian | |
| 7,886,676 | B2 | 2/2011 | Khachaturian | |
| 7,908,988 | B1 | 3/2011 | Khachaturian | |
| 7,985,108 | B1 | 7/2011 | Bekker et al. | |
| 8,061,289 | B2 | 11/2011 | Khachaturian | |
| 8,240,264 | B2 | 8/2012 | Khachaturian | |
| 8,240,265 | B1 | 8/2012 | Khachaturian | |
| 2002/0092456 | A1 | 7/2002 | Begnaud et al. | |
| 2010/0162935 | A1 | 7/2010 | Khachaturian | |
| 2011/0203507 | A1 | 8/2011 | Ellnor | |
| 2012/0073485 | A1 | 3/2012 | Khachaturian | |
| 2012/0118215 | A1 | 5/2012 | Tosello | |

* cited by examiner

SELF-PROPELLED, CATAMARAN-TYPE, DUAL-APPLICATION, SEMISUBMERSIBLE SHIP WITH HYDRODYNAMIC HULLS AND COLUMNS

BENEFIT CLAIMS TO RELATED APPLICATIONS

This application claims benefit of U.S. provisional App. No. 61/914,209 filed Dec. 10, 2013 in the name of Hugh Francis Gallagher, said provisional application being hereby incorporated by reference as if fully set forth herein.

BACKGROUND

The field of the present invention relates to ships. In particular, self-propelled, catamaran-type, dual-application, semisubmersible ships with hydrodynamic hulls and columns are described herein.

A wide variety of ships or vessels are available for various maritime applications. Some of these are described in:

U.S. Pat. No. 8,240,265 entitled "Method and apparatus for salvaging underwater objects" issued Aug. 14, 2012 to Khachaturian;

U.S. Pat. No. 8,240,264 entitled "Marine lifting apparatus" issued Aug. 14, 2012 to Khachaturian;

U.S. Pat. No. 8,061,289 entitled "Marine lifting apparatus" issued Nov. 22, 2011 to Khachaturian;

U.S. Pat. No. 7,985,108 entitled "Modular diesel hydraulic thruster system for dynamically positioning semi submersibles" issued Jul. 26, 2011 to Bekker et al.;

U.S. Pat. No. 7,908,988 entitled "Method and apparatus for salvaging underwater objects" issued Mar. 22, 2011 to Khachaturian;

U.S. Pat. No. 7,886,676 entitled "Marine lifting apparatus" issued Feb. 15, 2011 to Khachaturian;

U.S. Pat. No. 7,845,296 entitled "Marine lifting apparatus" issued Dec. 7, 2010 to Khachaturian;

U.S. Pat. No. 7,527,006 entitled "Marine lifting apparatus" issued May 5, 2009 to Khachaturian;

U.S. Pat. No. 6,719,495 entitled "Articulated multiple buoy marine platform apparatus and method of installation" issued Apr. 13, 2004 to Khachaturian;

U.S. Pat. No. 6,692,190 entitled "Articulated multiple buoy marine platform apparatus" issued Feb. 17, 2004 to Khachaturian;

U.S. Pat. No. 6,668,747 entitled "Load transfer system" issued Dec. 30, 2003 to Kjerstad;

U.S. Pat. No. 6,524,049 entitled "Semi-submersible, mobile drilling vessel with storage shaft for tubular drilling equipment" issued Feb. 25, 2003 to Minnes;

U.S. Pat. No. 6,435,774 entitled "Articulated multiple buoy marine platform apparatus" issued Aug. 20, 2002 to Khachaturian;

U.S. Pat. No. 6,435,773 entitled "Articulated multiple buoy marine platform apparatus and method of installation" issued Aug. 20, 2002 to Khachaturian;

U.S. Pat. No. 6,425,710 entitled "Articulated multiple buoy marine platform apparatus" issued Jul. 30, 2002 to Khachaturian;

U.S. Pat. No. 6,378,450 entitled "Dynamically positioned semi-submersible drilling vessel with slender horizontal braces" issued Apr. 30, 2002 to Begnaud et al.;

U.S. Pat. No. 6,367,399 entitled "Method and apparatus for modifying new or existing marine platforms" issued Apr. 9, 2002 to Khachaturian;

U.S. Pat. No. 6,364,574 entitled "Method and apparatus for the offshore installation of multi-ton packages such as deck packages and jackets" issued Apr. 2, 2002 to Khachaturian;

U.S. Pat. No. 6,318,931 entitled "Method and apparatus for the offshore installation of multi-ton packages such as deck packages and jackets" issued Nov. 20, 2001 to Khachaturian;

U.S. Pat. No. 6,247,421 entitled "Method for DP-conversion of an existing semi-submersible rig" issued Jun. 19, 2001 to Ludwigson;

U.S. Pat. No. 6,149,350 entitled "Method and apparatus for the offshore installation of multi-ton packages such as deck packages and jackets" issued Nov. 21, 2000 to Khachaturian;

U.S. Pat. No. 6,039,506 entitled "Method and apparatus for the offshore installation of multi-ton packages such as deck packages and jackets" issued Mar. 21, 2000 to Khachaturian;

U.S. Pat. No. 5,975,807 entitled "Method and apparatus for the offshore installation of multi-ton packages such as deck packages and jackets" issued Nov. 2, 1999 to Khachaturian;

U.S. Pat. No. 5,800,093 entitled "Method and apparatus for the offshore installation of multi-ton packages such as deck packages, jackets, and sunken vessels" issued Sep. 1, 1998 to Khachaturian;

U.S. Pat. No. 5,662,434 entitled "Method and apparatus for the offshore installation of multi-ton prefabricated deck packages on partially submerged offshore jacket foundations" issued Sep. 2, 1997 to Khachaturian;

U.S. Pat. No. 5,609,441 entitled "Method and apparatus for the offshore installation of multi-ton prefabricated deck packages on partially submerged offshore jacket foundations" issued Mar. 11, 1997 to Khachaturian;

U.S. Pat. No. 5,607,260 entitled "Method and apparatus for the offshore installation of multi-ton prefabricated deck packages on partially submerged offshore jacket foundations" issued Mar. 4, 1997 to Khachaturian;

U.S. Pat. No. 5,038,702 entitled "Semi-submersible platform" issued Aug. 13, 1991 to Bowes;

U.S. Pat. No. 4,909,174 entitled "Semi-submersible platform" issued Mar. 20, 1990 to Bowes;

U.S. Pat. No. 4,899,682 entitled "Catamaran-type semi-submersible drilling vessel for offshore drilling" issued Feb. 13, 1990 to Pouget et al.;

U.S. Pat. No. 4,646,672 entitled "Semi-submersible vessel" issued Mar. 3, 1987 to Bennett et al.;

U.S. Pat. No. 4,471,708 entitled "Self-propelled semi-submersible service vessel" issued Sep. 18, 1984 to Wilson et al.;

U.S. Pat. No. 4,436,050 entitled "Semi-submersible vessel" issued Mar. 13, 1984 to Liden;

U.S. Pat. No. 4,281,615 entitled "Self-propelled semi-submersible service vessel" issued Aug. 4, 1981 to Wilson et al.;

U.S. Pat. No. 4,273,067 entitled "Method of operating twin hull semisubmersible derrick barge" issued Jun. 16, 1981 to Lloyd et al.;

U.S. Pat. No. 4,257,718 entitled "Semi-submersible pipe-laying craft equipped for laying pipes on sea beds, including deep beds, and the method of operation" issued Mar. 24, 1981 to Rosa et al.;

U.S. Pat. No. 4,166,426 entitled "Method of construction of twin hull variable draft vessel" issued Ser. No. 09/041,979 to Lloyd;

U.S. Pat. No. 4,165,702 entitled "Method of constructing a twin hulled, column stabilized, semi-submersible derrick barge" issued Aug. 28, 1979 to Lloyd et al.;

U.S. Pat. No. 4,150,635 entitled "Twin hull semi-submersible derrick barge" issued Apr. 24, 1979 to Lloyd et al.;

U.S. Pat. No. 4,091,760 entitled "Method of operating twin hull variable draft vessel" issued May 30, 1978 to Lloyd;

U.S. Pat. No. 3,857,352 entitled "Pontoon boat" issued Dec. 31, 1974 to Schott;

U.S. Pat. No. 3,835,800 entitled "Twin hull semi-submersible derrick barge" issued Sep. 17, 1974 to Lloyd et al.;

U.S. Pat. No. 3,771,481 (RE29478) entitled "Single column semisubmersible drilling vessel" issued Nov. 13, 1973 to Goren et al.;

U.S. Pat. No. 3,763,809 entitled "Semi-submersible work platform" issued Oct. 9, 1973 to Pazos;

U.S. Pat. No. 3,673,974 entitled "Method and mobile marine platform apparatus having floating submerged mat stabilization" issued Jul. 4, 1972 to Harper;

U.S. Pat. No. 3,653,354 entitled "Catamaran stabilizer" issued Apr. 4, 1972 to Pangalila;

U.S. Pat. No. 3,616,773 (RE29167) entitled "Twin hull, variable draft drilling vessel" issued Nov. 2, 1971 to Lloyd;

U.S. Pat. No. D197,868 entitled "Catamaran offshore drilling vessel" issued Mar. 31, 1964 to Thornton;

U.S. Pub. No. 2002/0092456 entitled "Dynamically positioned semi-submersible vessel" published Jul. 18, 2002 in the names of Begnaud et al.;

U.S. Pub. No. 2010/0162935 entitled "Marine Lifting Apparatus" published Jul. 1, 2010 in the name of Khachaturian;

U.S. Pub. No. 2011/0203507 entitled "Ocean going transport vessel with docking arrangements" published Aug. 25, 2011 in the name of Ellnor;

U.S. Pub. No. 2012/0073485 entitled "Marine lifting apparatus" published Mar. 29, 2012 in the name of Khachaturian;

U.S. Pub. No. 2012/0118215 entitled "Catamaran Ship Used for Assembling, Transporting and Installing a Marine Wind Turbine on the Seafloor" published May 17, 2012 in the name of Tosello; and Belait CSS 1 launched in 2013 by STX Marine, Inc.

Each of the patents and publications listed above is incorporated by reference as if fully set forth herein.

Various of the references listed above disclose catamaran-type vessels for maritime lifting, drilling, or other operations. The catamaran hulls in some examples are floating, barge-type hulls; in other examples the catamaran hulls are semisubmersible hulls that enable the vessel to be raised or lowered relative to the water surface. Some of the vessels disclosed include various degrees of self-propulsion for maneuvering, positioning, station-keeping, or cruising. The vessels disclosed in the listed references are limited in their abilities to operate in rough seas or high wind, in their cruising ranges, or in their cruising speeds.

In the United Stated Offshore Continental Shelf portion of the Gulf of Mexico alone (i.e., within the 200-mile economic exclusive zone) there are currently over 1000 oil drilling or production platforms, many of them submerged, that have been condemned by the U.S. Department of the Interior. A need exists for a working vessel for recovering those structures, and others elsewhere, that can rapidly transit large distances and that can cruise or work on a year-round basis in a wide range of potentially adverse conditions at sea, e.g., in rough seas, high wind, or heavy weather.

SUMMARY

A semisubmersible vessel can comprise: a first hull, one or more columns extending upward from the first hull, a second hull, one or more columns extending upward from the second hull, and one or more cross members joining the first hull or its columns and the second hull or its columns. The first and second hulls are shaped to reduce hydrodynamic drag; the one or more columns can also be shaped to reduce hydrodynamic drag. The hulls include one or more self-propulsion units mounted at various locations for various purposes (e.g., cruising, maneuvering, station-keeping, and so on).

Objects and advantages pertaining to semisubmersible vessels may become apparent upon referring to the example embodiments illustrated in the drawings and disclosed in the following written description.

This summary is provided to introduce a selection of concepts in a simplified form that are further described below in the Detailed Description. This Summary is not intended to identify key features or essential features of the subject matter subsequently claimed, nor is it intended to be used as an aid in determining the scope of such subsequently claimed subject matter.

Figure 1:
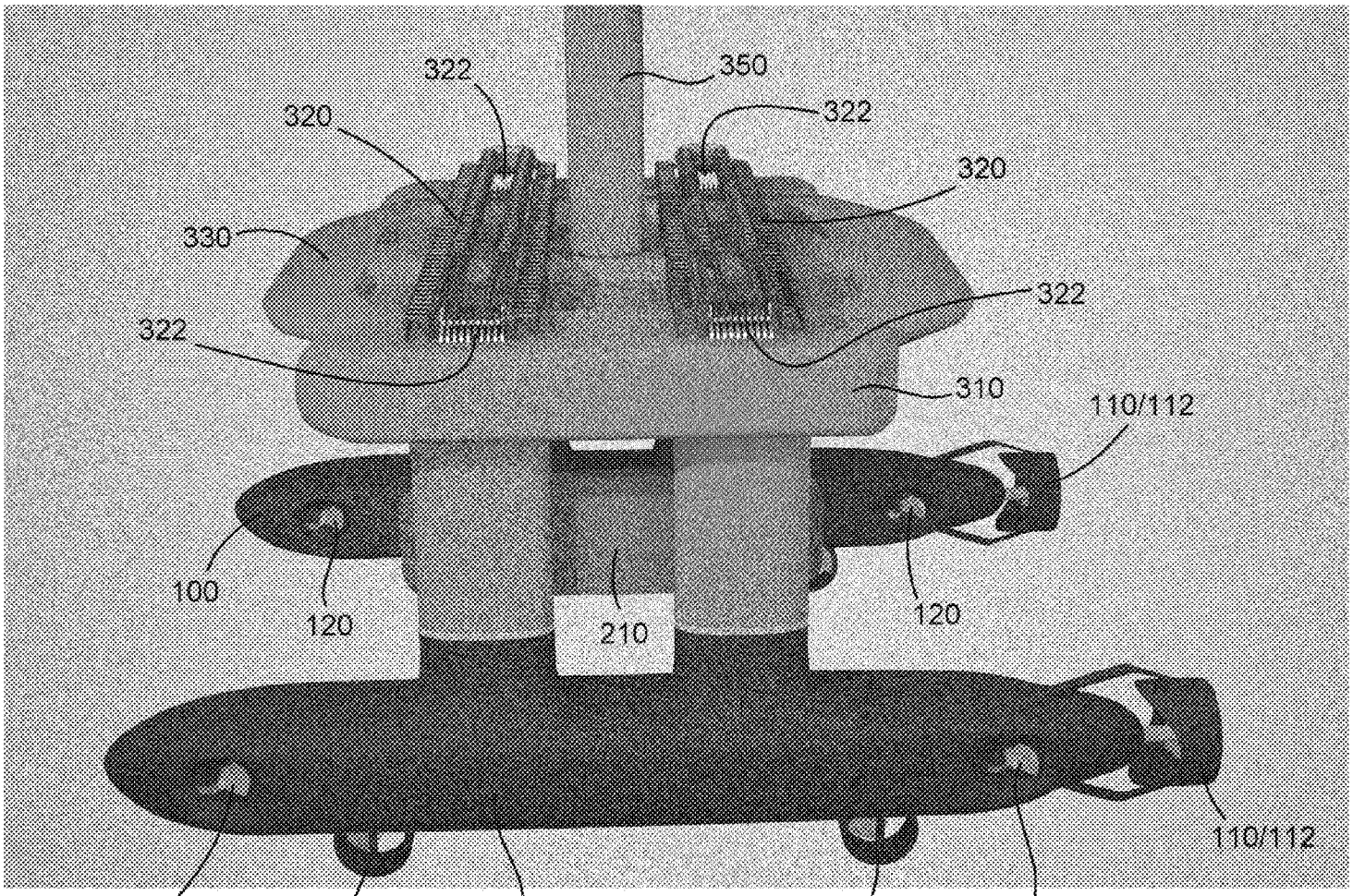
FIG. 1 is a side view of a model of a first example of a semisubmersible vessel with hulls, columns, modules, a platform cross member, propellers, drop-down thrusters, and tunnel thrusters.
Figure 2:
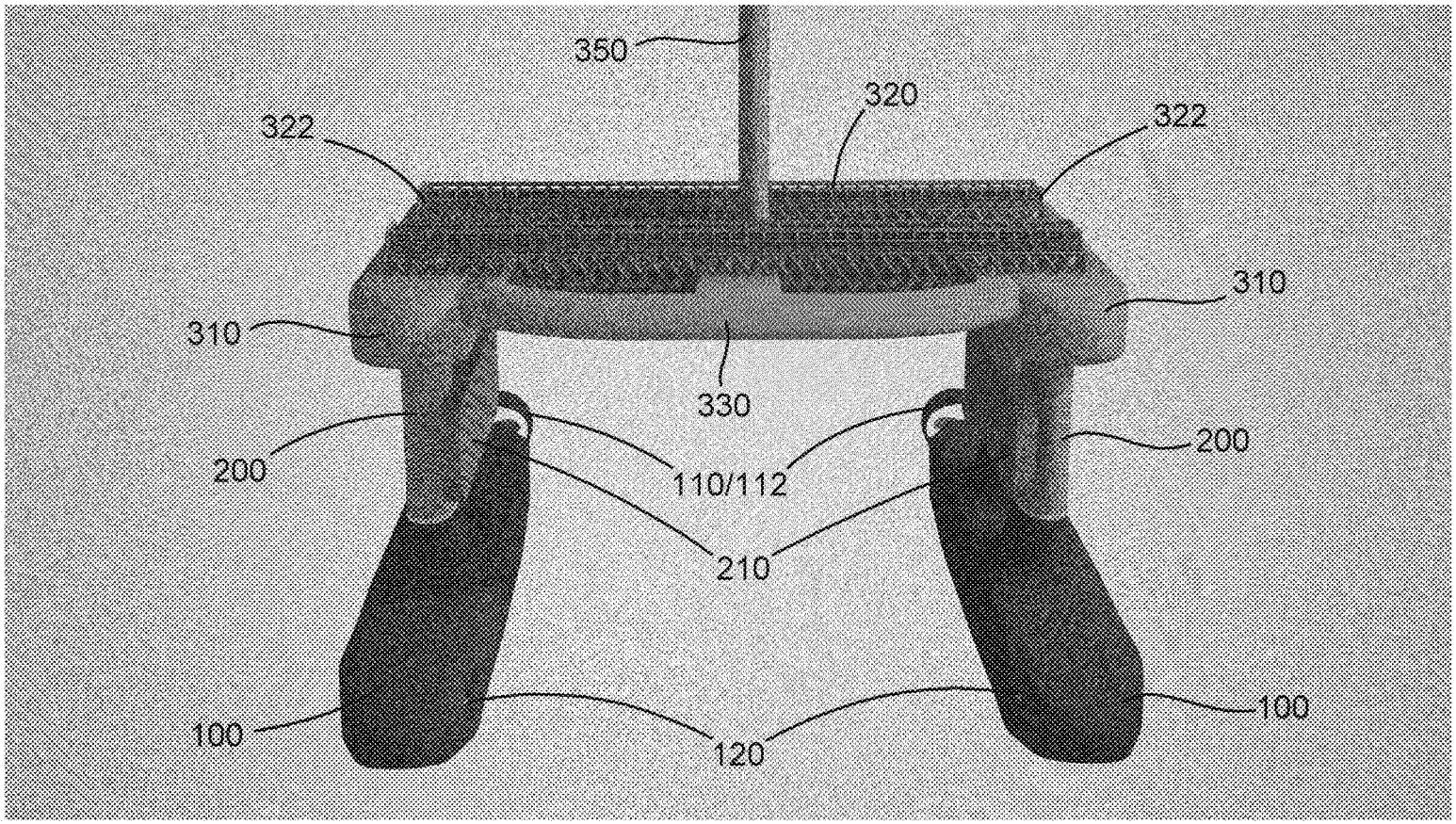
FIG. 2 is front view of the model of FIG. 1.
Figure 3:
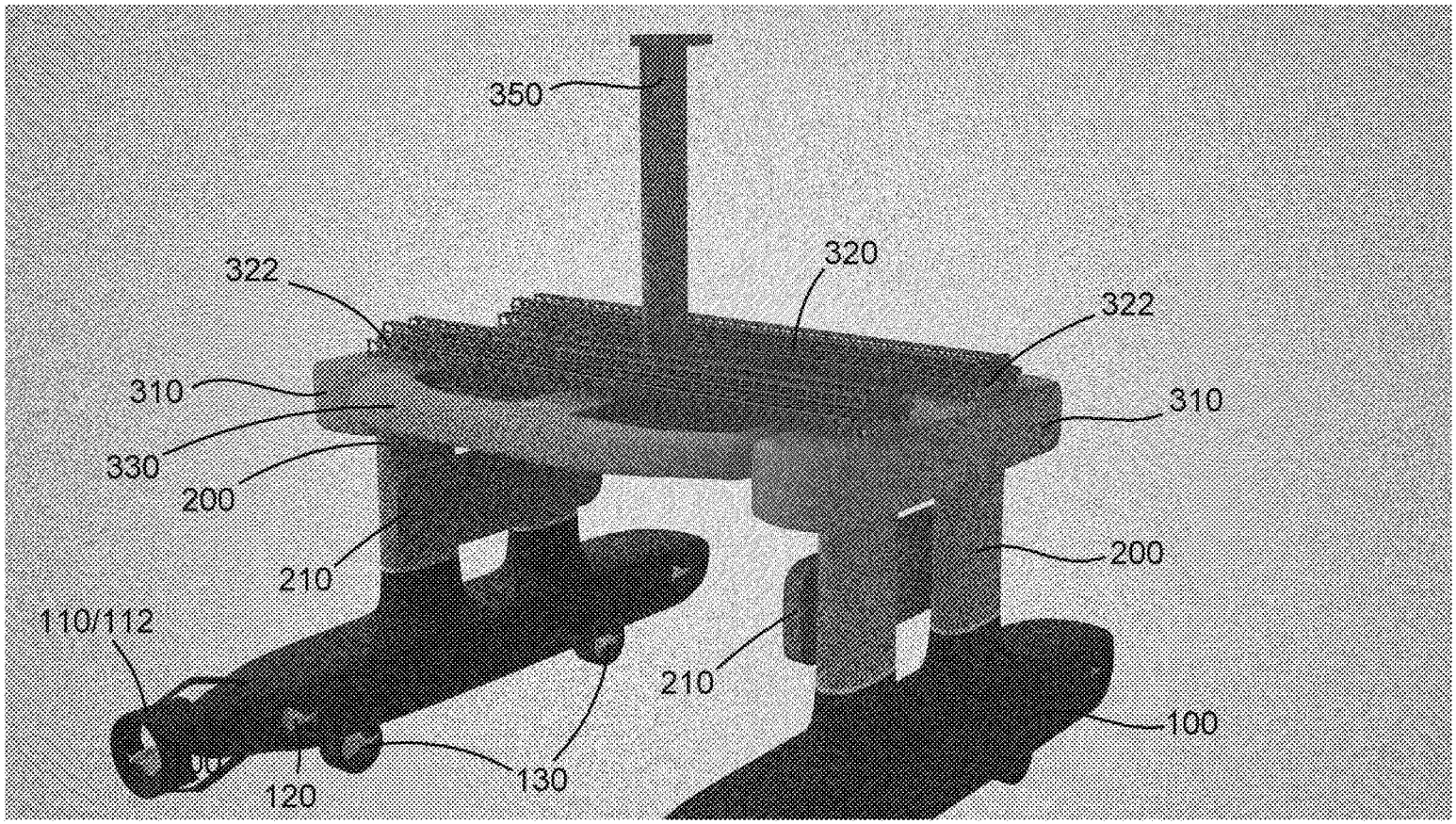
FIG. 3 is an oblique partial view of the model of FIG. 1.
Figure 4:
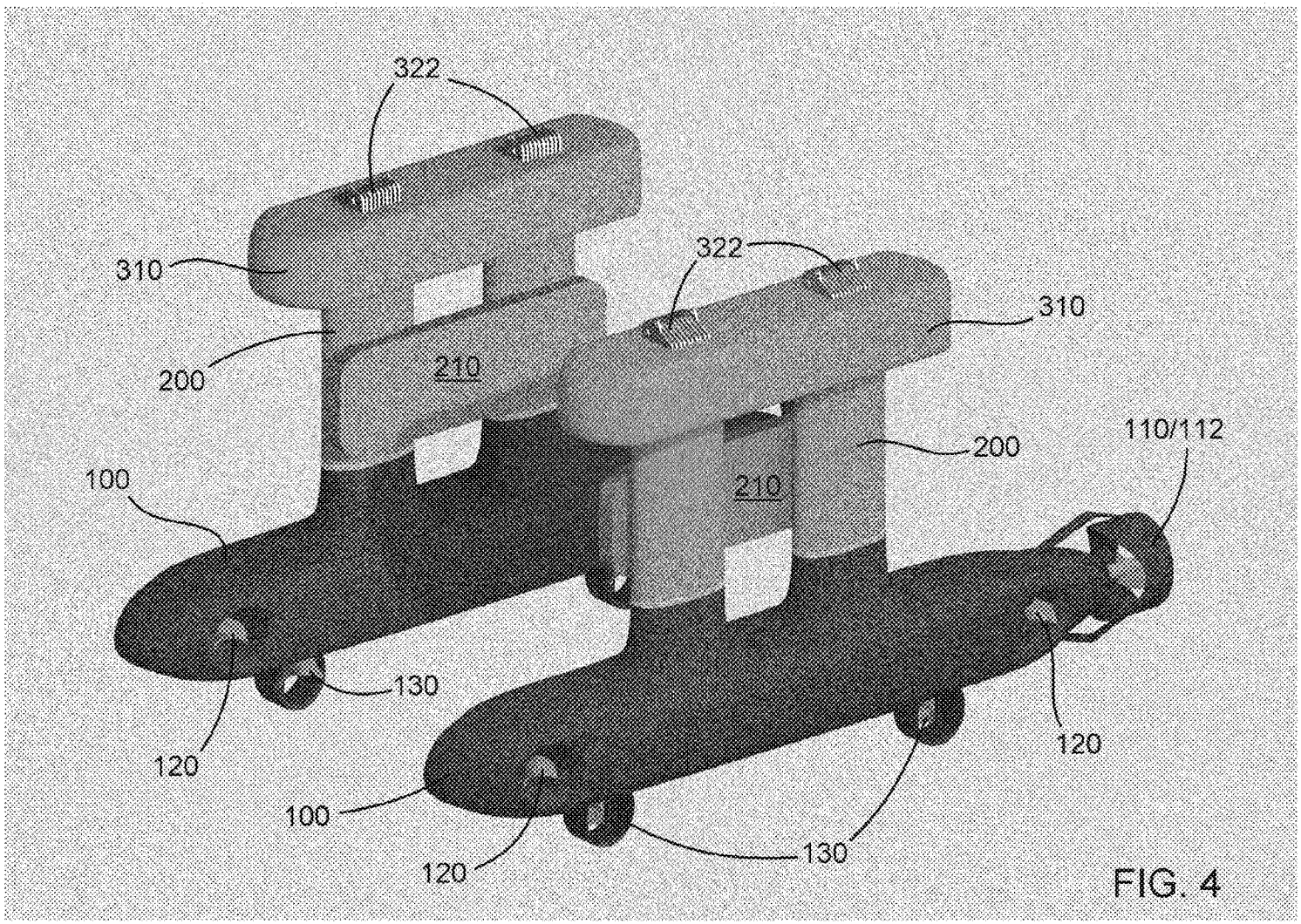
FIG. 4 is an oblique view of the model of FIG. 1 without the platform cross member.
Figure 5:
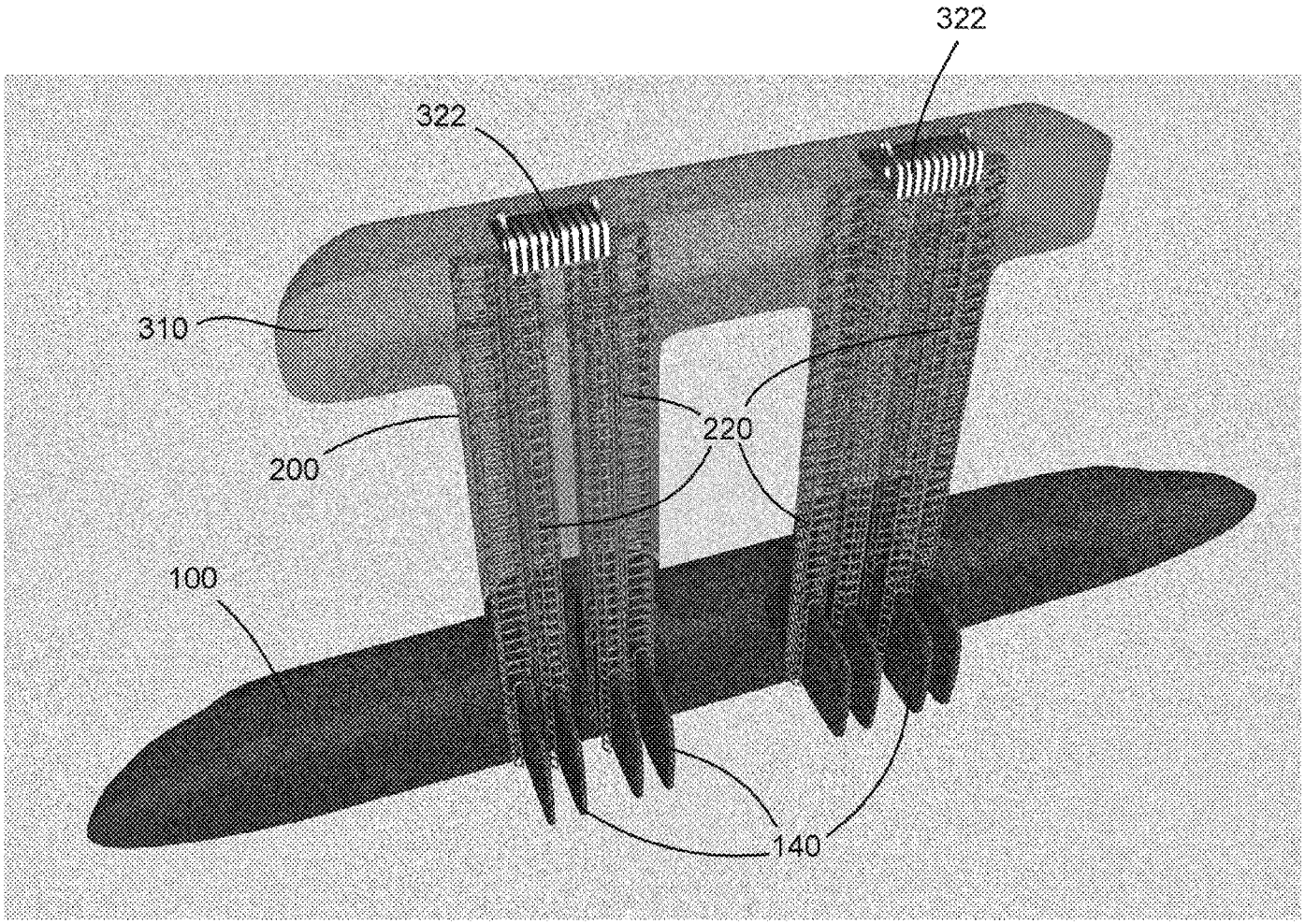
FIG. 5 is a cut-away view of one of the hulls and the corresponding columns and module(s) of the model of FIG. 1.
Figure 6:
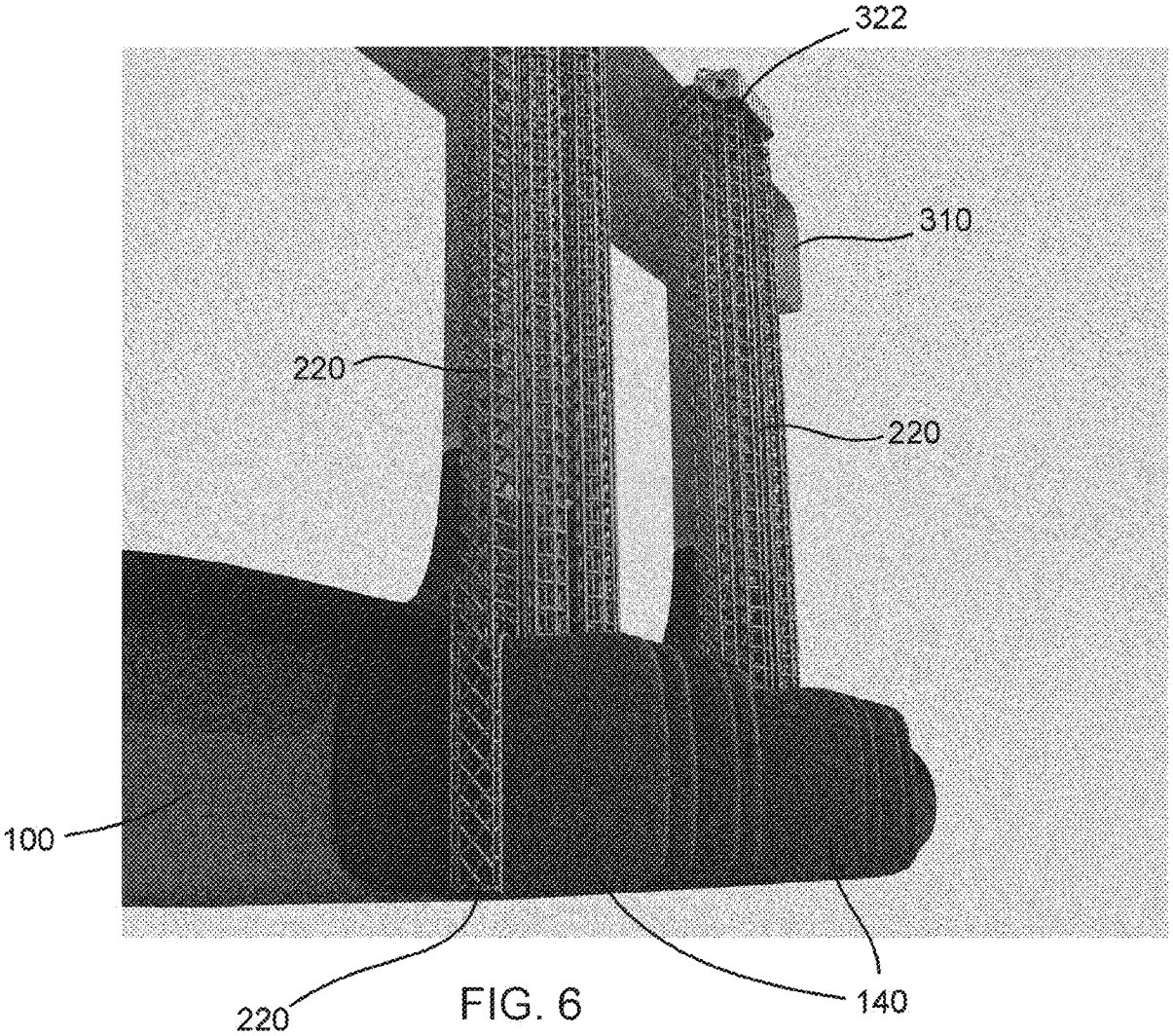
FIG. 6 is a cut-away partial view of one of the hulls and the corresponding columns and module(s) of the model of FIG. 1.
Figure 7:
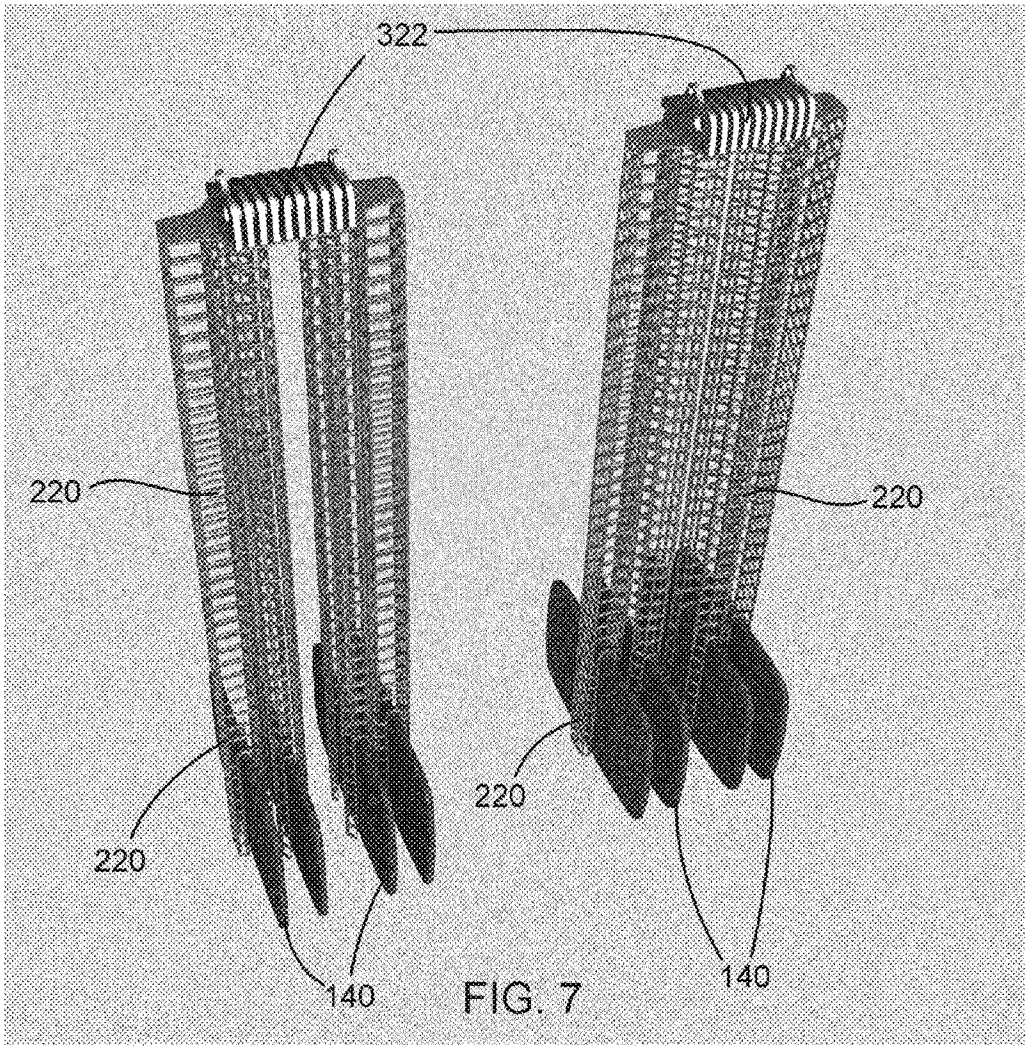
FIG. 7 is a partial view of the interior of the columns of the model of FIG. 1.
Figure 8:
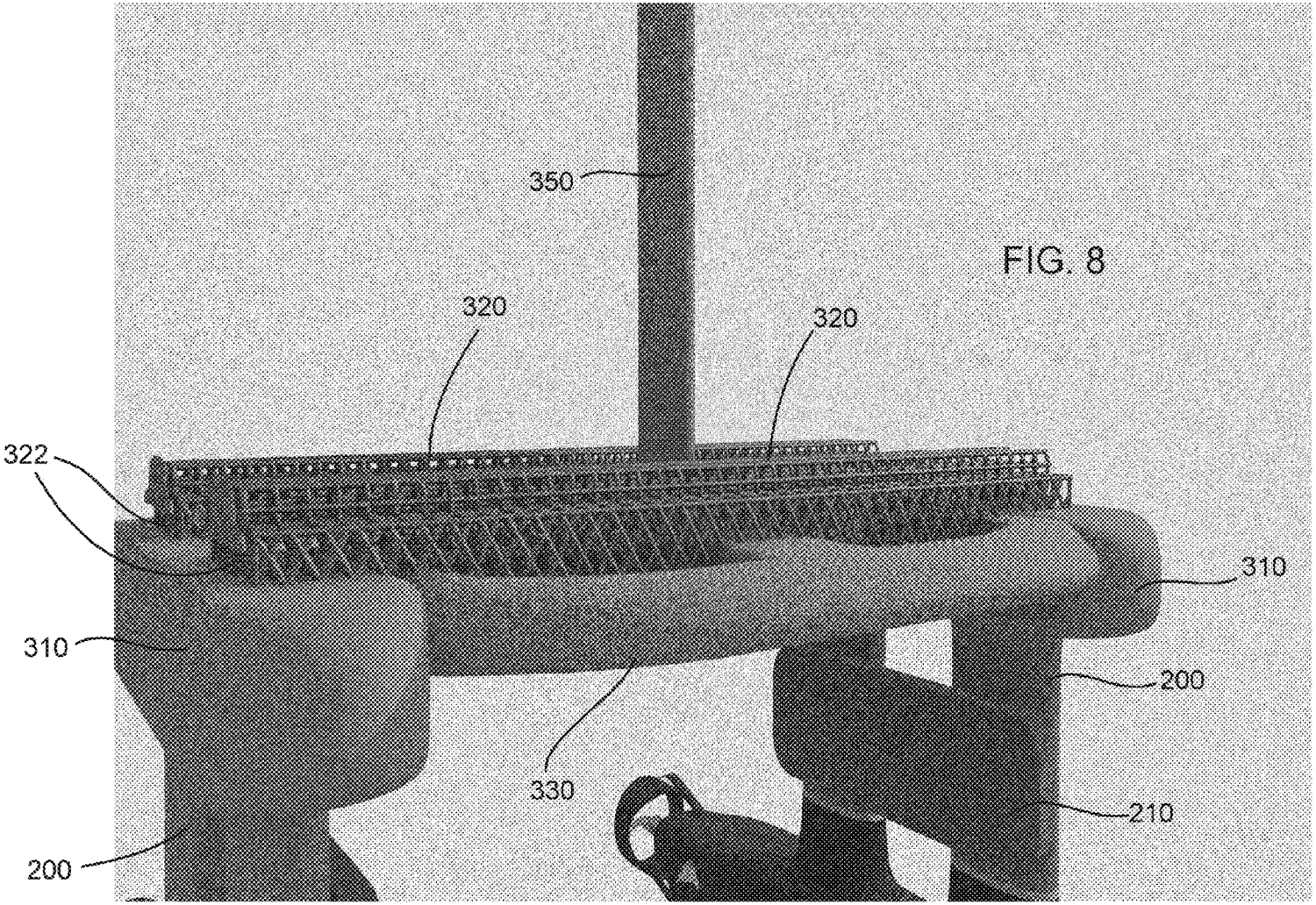
FIG. 8 is an enlarged view of the modules and platform cross member of the model of FIG. 1.

It should be noted that the embodiments depicted in this disclosure are shown only schematically, and that not all features may be shown in full detail or in proper proportion. Certain features or structures may be exaggerated relative to others for clarity or emphasis (e.g., the thrusters relative to the hulls). It should be noted further that the embodiments shown are examples only, and should not be construed as limiting the scope of the written description or subsequently presented claims.

DETAILED DESCRIPTION OF EMBODIMENTS

It would be desirable to provide a vessel that can engage in recovery operations such as those described above at greater depths and in less favorable conditions than previous vessels. In particular, it would be desirable to produce a vessel that can cruise under its own power at speeds greater than about 15 knots or even greater than about 20 knots, that can operate at depths exceeding about 700 feet, that can continue to operate in seas greater than about 6 feet, and can continue to operate in wind in excess of about 30 knots. The examples described below achieve those objectives.

Example 1

A semisubmersible vessel can comprise: a first hull 100, one or more columns 200 extending upward from the first hull 100, a second hull 100, one or more columns 200 extending upward from the second hull 100, and one or more cross members joining the first hull 100 or its columns 200 and the second hull 100 or its columns 200. The cross members can comprise one or more metal pipe matrices 320 (as in FIGS. 1-3, 8, and 9), one or more platforms 330 (as in FIGS. 1-3, 8, and 9), one or more arches 390 (as in FIG. 10), one or more boxed beams, or combinations thereof. The first and second hulls 100 are shaped to reduce hydrodynamic drag; there are no sharp edges, and all corners are radiused or rounded and decks are cambered, so as to encourage laminar flow and to reduce turbulence and vortex fields. Reduced drag results in less friction, higher speed, and reduced fuel consumption. Suitable hydrodynamic hull shapes can include, e.g.: "cigar", "teardrop", or "Albacore" hulls typically employed for naval submarines such as the USS George Washington (SSBN-598); or other streamlined, spindle-shaped, or ellipsoid-like shapes. The hulls typically are tapered more toward their sterns than toward their bows for improved hydrodynamic performance. The hulls include one or more self-propulsion units mounted at various locations for various purposes (e.g., cruising, maneuvering, station-keeping, and so on; see below).

Example 2

The vessel of Example 1 can be further adapted, arranged, or configured so that each one of the hulls 100 is divided by transverse frames or bulkheads 140. The frames 140 can define the transverse cross section of the hulls 100 and can be linked along each hull 100 by longitudinal structural members (e.g., by stringers), while the bulkheads 140 can divide the hulls 100 into discrete, water-tight chambers; in one specific example each hull 100 can be divided into twenty-six such compartments. The frames or bulkheads 140 provide structural support and integrity, and the discrete, water-tight chambers can reduce or prevent downflooding of other compartments when one of them is flooded, e.g., by being damaged or otherwise breached. In one particular example, the hydrodynamic shape of each hull 100 can comprise: a rounded bow section with a drag coefficient less than about 0.1, less than about 0.08, or less than about 0.06 through the first four frames; a middle section having a substantially constant transverse cross-section from frames 5 through 14; and a tapered section tapering at a 2:1 aspect ratio from frames 15 through 26. Each hull 100 can terminate with a shaft supporting variable-pitch propellers or impellers 110. Each propeller 110 can be surrounded by a corresponding Kort nozzle 112 and act as a rudder. Each hull 100 can have a length greater than about 300 feet and a beam greater than about 50 feet; other suitable sizes (larger or smaller) can be employed as needed for a particular vessel. In one specific example, each hull 100 is about 360 feet long (including propellers), about 60 feet wide, and about 50 feet high, and the overall width of the vessel is about 300 feet.

Example 3

Figures 13, 14, 15:
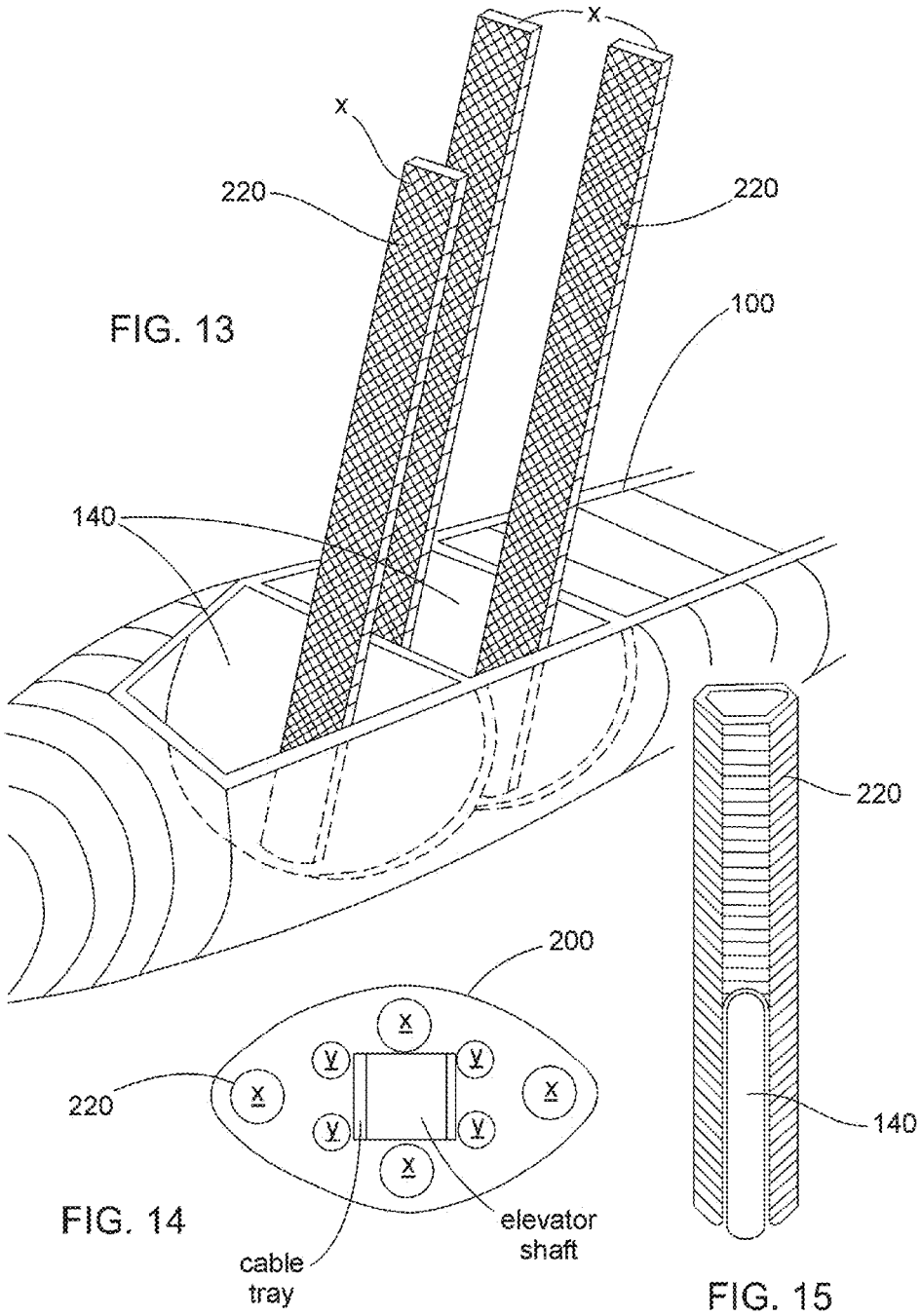
FIG. 13 is a schematic oblique, partially cut-away view of a portion of a hull and steel pipe matrices of one of the columns (only three of four steel pipe matrices are shown). Each steel pipe matrix is shown engaged with one of the bulkheads within the hull.
FIG. 14 is a schematic horizontal cross section of one of the columns showing an example of an arrangement of four steel pipe matrices (labeled "x"), four utility columns (labeled "y"), a cable tray, and an elevator shaft within a foil-shaped column.
FIG. 15 illustrates schematically one example of an arrangement for engagement of a column steel pipe matrix with a bulkhead within the hull.
Figure 16:
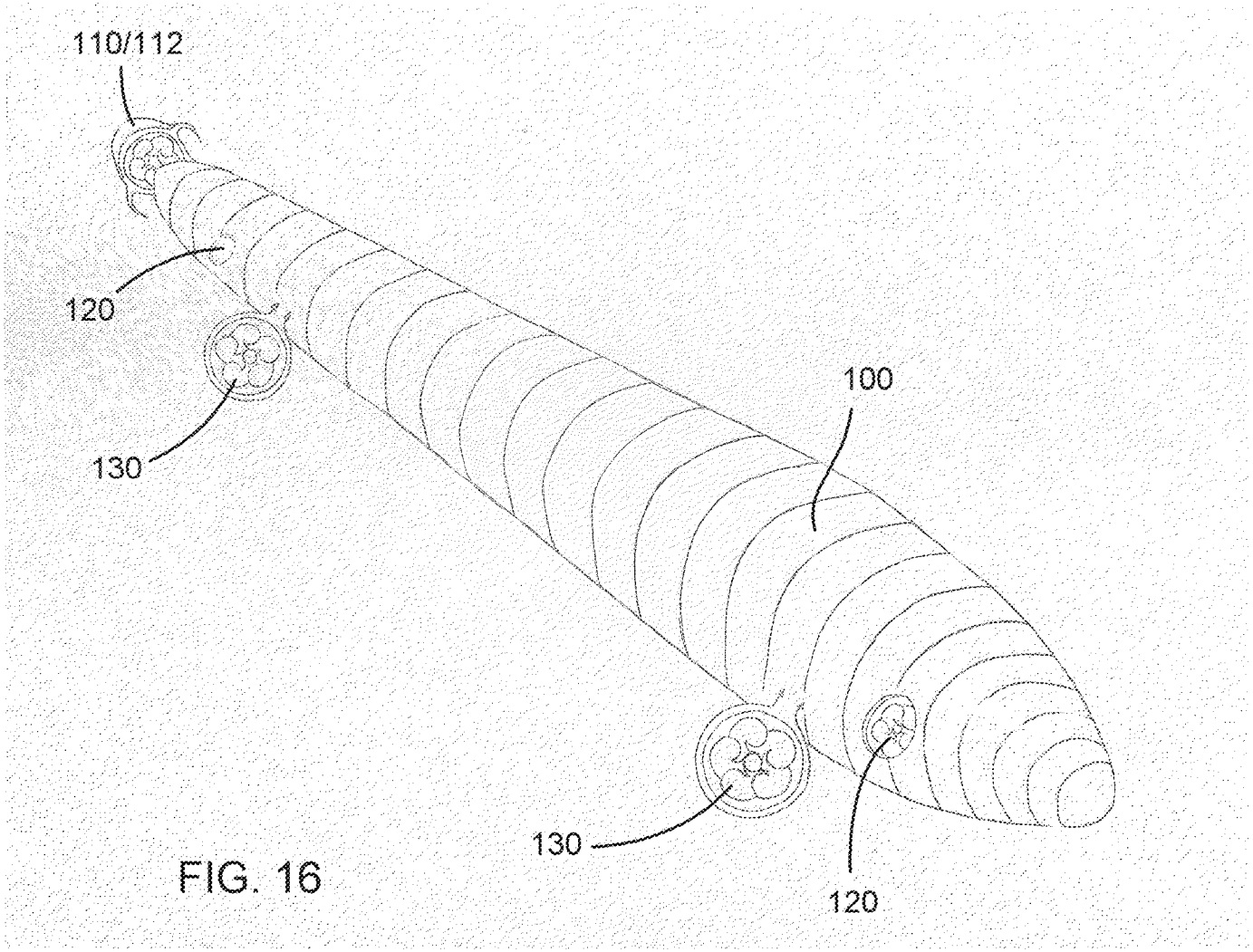
FIG. 16 is an enlarged oblique view of the one hull.
Figures 17A, 17B, 17C:
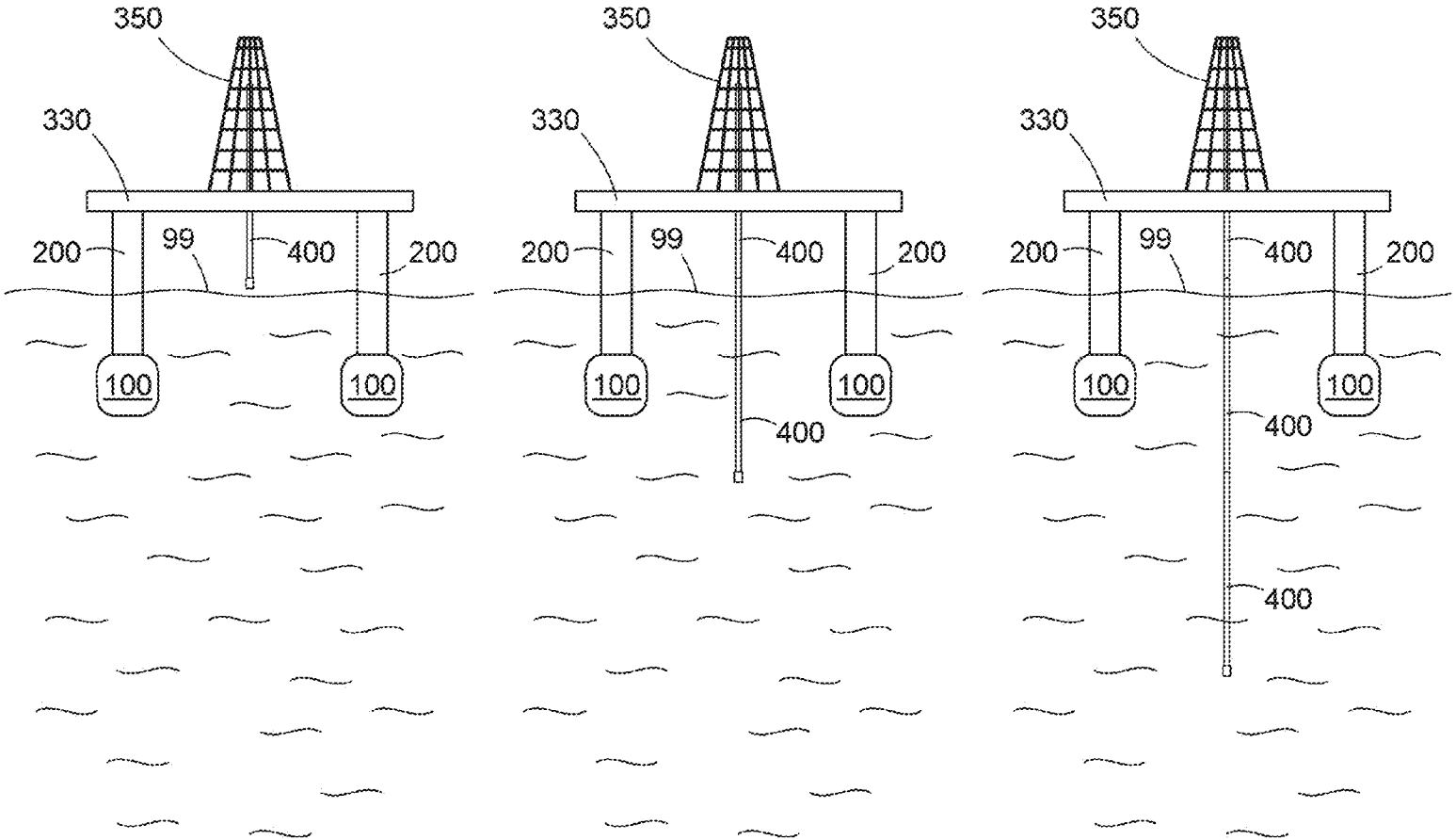
FIGS. 17A-17C illustrate schematically an example of use of a crane and drill pipe segments as a lifting system on an example of a semisubmersible vessel.

The vessel of Examples 1 or 2 can be further adapted, arranged, or configured so that the middle section (i.e., frames 5 through 14) of each hull 100 is flattened on its dorsal (top) side to accommodate two or more vertical towers or columns 200 per hull. In a typical example two columns 200 are positioned on each hull 100, for a total of four columns 200 for the vessel. The vertical columns 200 each have a foil-shaped horizontal cross-section (in some examples a symmetric foil-shaped cross-section; FIG. 14) for reducing hydrodynamic drag during fore and aft motion of the vessel through water, and for reducing the effect of surface motion of the water on the vessel. In typical operation, the columns 200 are the only portions of the vessel that intersect the surface of the water. In some instances, the structural components of the columns 200 can comprise a steel pipe matrix 220; each one of those can rest on and join the keel of the corresponding hull 100, or can be connected directly to a transverse internal framework or bulkheads 140 of the corresponding hull 100. Each column 200 can extend to a height of one or several hundred feet above the keel of the corresponding hull 100; in one instance the columns 200 extend about 200 feet above the keels.

One or more modules 310 can be included on or within one or more of the columns 200; modules 310 can be included to provide one or more of: crew accommodations (e.g., crew quarters or berthing hotel, galley facilities, shops), bridge facilities (e.g., navigation, communications), engineering facilities, administrative or business offices or other facilities, power generation facilities, remotely operated vehicle (ROV) facilities, or facilities for other vessel needs or functions. Such modules 310 typically are arranged at the top of the columns 200 and in a row substantially parallel to the hulls 100. In one specific example, the modules 310 can be about 50 feet high and about 60 feet wide and can be positioned on the columns 200 so that the distance from the top of the corresponding hull 100 to the bottom of the module 310 is about 80 feet. One or more of the columns 200 can include one or more elevators or utility conduits, cable trays, wiring, lines, piping, and so forth (FIG. 14). The top of each column 200 can include lower portions of one or more hinges 322 for connecting each column 200 to one or more of the cross members (e.g., the pipe matrix 320 or the platform 330; the cross members include corresponding upper portions of the one or more hinges 322), to enable some relative motion of the cross members and the columns/hulls. The hydrodynamic profiles of the hulls 100 and columns 200 enable the vessel to work in more hostile maritime conditions (e.g., high winds or heavy seas) than similar vessels lacking such hydrodynamic elements. The vessel can be employed as a salvage vessel, a heavy lift ship, a platform for recovery of ships, submarines, or aircraft, a column-stabilized offshore drilling unit, a production platform, a construction platform, a scientific research facility, an intelligence-gathering or reconnaissance platform (e.g., using sonar, radar, or electronic surveillance), or military facility (e.g., a weapons launch platform). Suitable corresponding modules 310 can be included at the tops of one or more of the columns 200 or mounted on the cross members to enable the vessels to act in each of those capacities.

So-called chafing boards 210 can be mounted on the columns 210 to prevent direct contact between the columns 210 and any vessel, barge, or salvaged objects in the volume between the columns. The chafing boards 210 can be of any standard or suitable type, e.g., wooden members held by a metal frame or housing so that any contact with a vessel or object between the columns is with the wooden members and not with the columns 200.

Example 4

The vessel of any of Examples 1-3 can be further adapted, arranged, or configured so that each one of the columns 200 comprises a corresponding steel pipe matrix 220. The foil-shaped outer surface of each column 200 (FIG. 14) shields the steel pipe matrix 220 from contact with the water. Each such steel pipe matrix 220 can originate on the keel or on the transverse bulkheads 140 of the corresponding hull (FIGS. 5-7, 13, and 15); in one specific example the pipe matrices 220 can "fork over" corresponding bulkheads 140. Each steel pipe matrix 220 extends upward through (and at least partly supports) a corresponding column 200 and its foil-shapes outer surface, at least partly supports any modules 310 at the top of that column, and is connected to one or more of the cross members (e.g., transverse pipe matrix 320 or platform 330), often by a hinge 322. Interior spaces within each pipe matrix 220 can accommodate elevators, cable trays, piping or conduits, and so forth. In some instances the steel pipe matrix can join the hulls together in the form of boxed beams or pipe matrix 320 connected to the hinges 322 at the tops of the columns 200 and pipe matrices 220. The pipe matrix 320 can support a main deck 330 that is an extension of the modules 310 at the top of one or more of the columns 200, i.e., the main deck 330 is also substantially parallel to the modules 310 and the hulls 100 and therefore substantially horizontal. Such a main deck 330 can support whatever equipment is suitable for a given use of the vessel, including but not limited to those listed in Example 3. In one example, the main deck can support a tower derrick crane (represented schematically as element 350 in FIGS. 1-3, 8 and 9).

Figure 10:
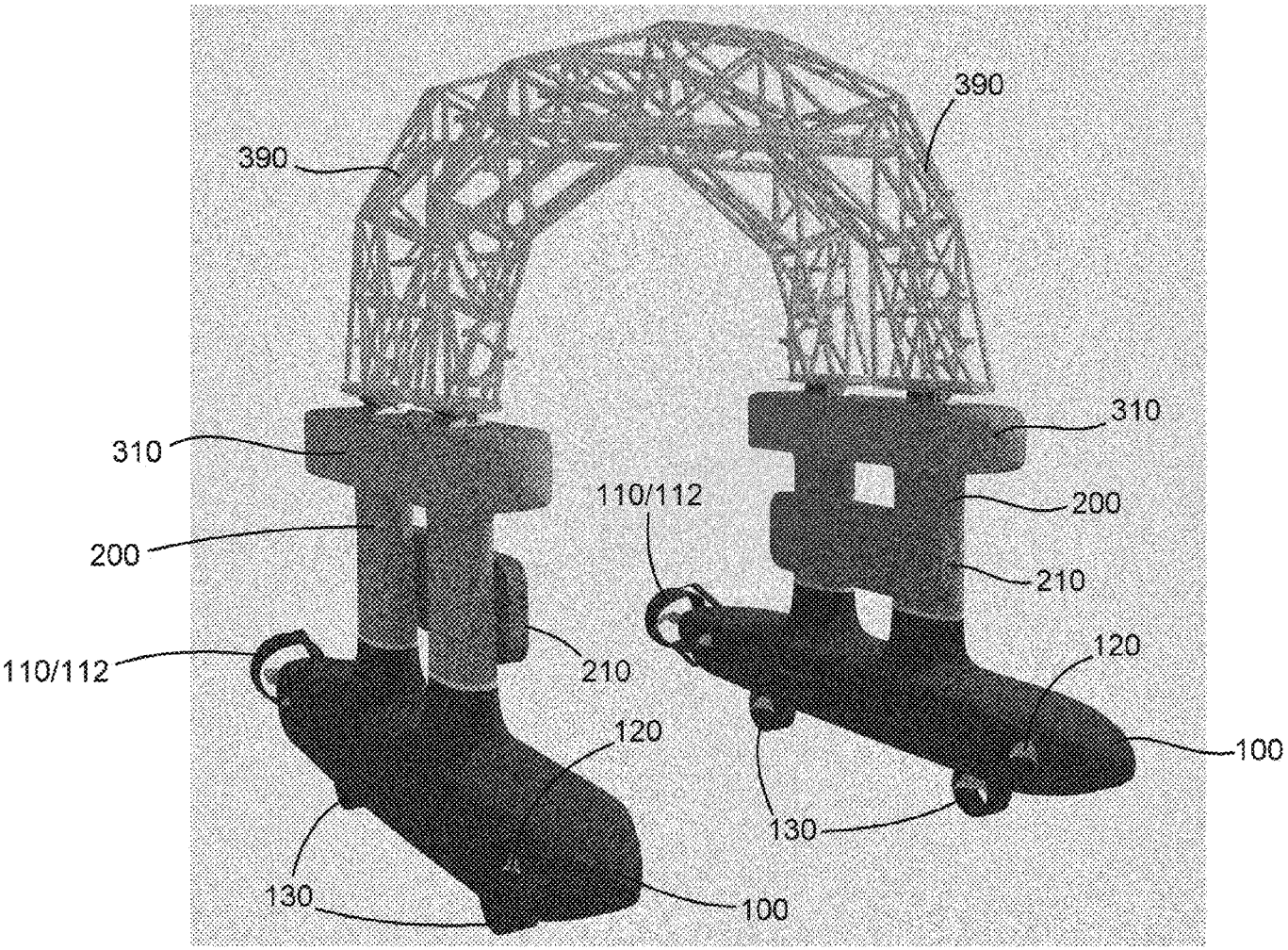
FIG. 10 is an oblique view of a model of a second example of a semisubmersible vessel with hulls, columns, modules, arched cross members, propellers, drop-down thrusters, and tunnel thrusters.
Figure 11:
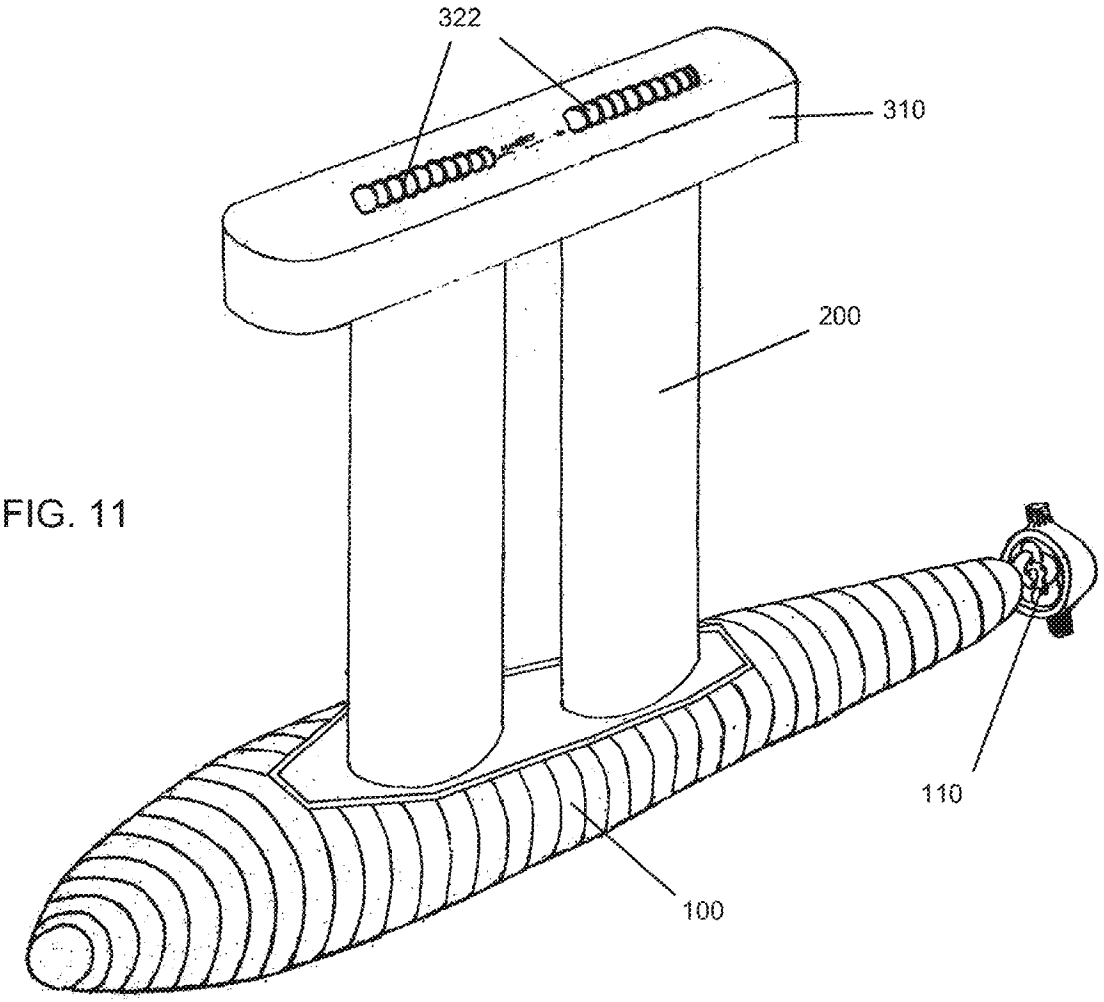
FIG. 11 is a schematic oblique view of one hull of a semisubmersible vessel and its corresponding columns and module(s). Thrusters and many of the bulkheads have been omitted for clarity.
Figure 12:
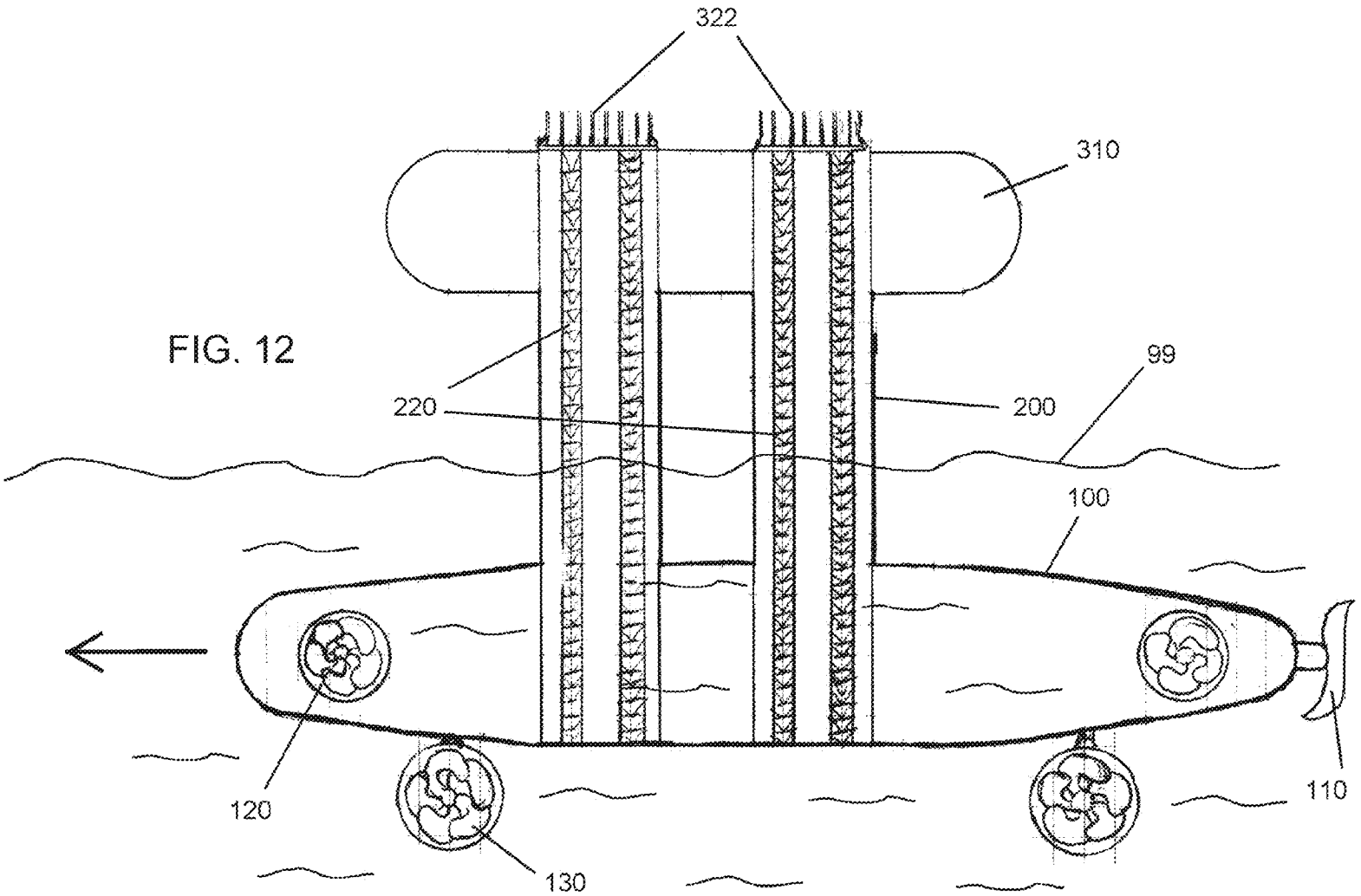
FIG. 12 is a schematic longitudinal cross section of one hull of a semisubmersible vessel and its corresponding columns, module(s), and thrusters. In this example the columns comprise steel pipe matrices contained within a foil-shaped column. The vessel is shown moving through the water with the hulls below the surface of the water and the columns extending through the surface of the water, leaving a space above the surface of the water below the platform that is parallel to the surface of the water.

In some other instances a combination of arches and boxed beams can be employed. In some instances, the steel pipe matrix 220 can continue upward and across in the form of an arch 390 connecting the two hulls 100 (i.e., acting as cross members; FIG. 10); in one specific example of that arrangement the total height of the vessel is about 300 feet. The lower end of each arch 390 is connected to the top of one or more of the columns 200, often by the aforementioned hinge 322.

Example 5

Figure 9:
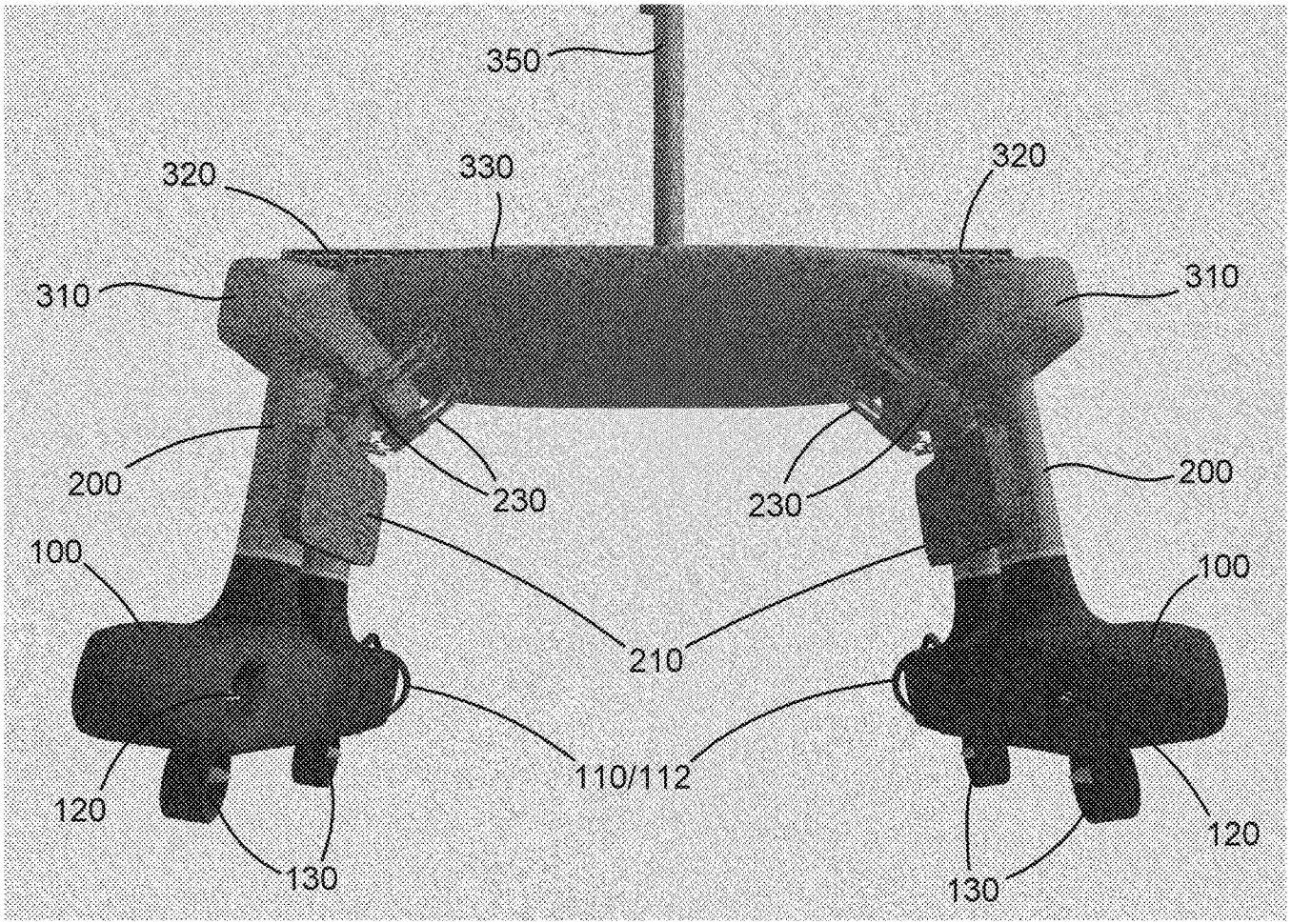
FIG. 9 is a front view of the model of FIG. 1 with the columns canted relative to the platform cross member.

The vessel of any of Examples 1-4 can be further adapted, arranged, or configured so that the hinges allow each hull 100 and its corresponding columns 200 to cant up to about 8° outward relative to the cross members, thereby enhancing the stability of the vessel in rough seas (FIG. 9). Hydraulic rams 230 can be employed as actuators to set a desired angle between the cross members (e.g., the platform 330 in FIG. 9) and the columns 200. In some examples, Smit-type pins can be employed to lock the hinges at a desired angle between the platform 330 and the columns 200; other suitable locking mechanisms can be employed. Hydraulic rams 230 act as gusset- or strut-like structural members that strengthen the coupling of the columns 200 and the pipe matrix 320 or platform 330 to enhance the robustness and structural integrity of the vessel.

Example 6

The vessel of any of Examples 1-5 can be further adapted, arranged, or configured so that the structural integrity holding the vessel together is dependent on the one or more cross members in the form of one or more metal pipe matrices 320, one or more platforms 330, one or more arches 390, one or more boxed beams, or combinations thereof. The cross members can be connected to the columns 200 at the top of any modules 310 that might be present, typically without cross bracings, X-bracings, K-bracings, lower transverse cross arms, or other structural members that extend horizontally at or near the water surface 99 to connect the hulls 100 or columns 200 together. Hydraulic rams 230 act as gusset- or strut-like structural members that strengthen the coupling of the columns 200 and the pipe matrix 320 or platform 330 to enhance the robustness and structural integrity of the vessel. Lack of transverse structural members at or near the water keeps the area of water surface 99 between the hulls and columns unobstructed to allow other ships, barges, other equipment or machinery, or lifted objects (e.g., salvage) to enter that area substantially unimpeded. For example, in a typical salvage operation the salvaged object can be lifted and suspended over the water while another vessel such as a barge maneuvers between the columns 200 below the object, which can then be lowered onto the barge. In some instances the salvaged object can be suspended below water while a submerged drydock is moved into place below the object.

Example 7

In the vessel of any of Examples 1-6, each hull can further include one or more self-propulsion sources. In some instances conventional propellers 110 can be fitted to propeller shafts at the aft end of each hull and act as the primary propulsion source for high-speed cruising. Each propeller can be shrouded by a corresponding Kort nozzle 112. Each propeller 110 can have controllable, variable pitch and act as a rudder or steering device. Any suitable drive system can be employed for driving the propellers 110 and can be housed within the corresponding hull 100, one of the corresponding columns 200, or in a corresponding module 310. If housed outside the hull 100, a transmission mechanism of any suitable type would be needed to couple the drive system to the propeller shaft in the corresponding hull 100. In one specific example, electric motors mounted in the hulls 100 drive the propellers 110; power to drive the electric motors is generated in one or more modules 310 at the top of the corresponding columns 200, e.g., by one or more diesel-electric generators, leaving more space in the hulls 100 available for ballast or pumping equipment.

In some instances, one or more drop-down thrusters 130 can be located on the ventral (bottom) surface of each hull 100. The thrusters 130 typically can be rotated to be directed in any desired direction (e.g., forward, aft, transversely, or in some intermediate orientation) and can be used primarily for maneuvering, station-keeping, or assisting in getting underway. In one example, one drop-down thruster 130 is located near the bow, forward of frame 6, and another is located near the stern, aft of frame 20. The drop-down thrusters 130 vertically deploy from and retract into the corresponding hull 100, preferably with a hatch for maintaining a streamlined hull profile when closed. Each drop-down thruster 130 is preferably received into its own watertight cofferdam. In some instances each hull 100 includes one or more transverse thrusters 120, each mounted in its own tunnel through the corresponding hull 100, preferably with hatches for maintaining a streamlined hull profile when closed. Each tunnel thruster 120 can be enclosed in its own watertight cofferdam. Tunnel thrusters 120 can be particularly useful in shallow-draft situations when drop-down thrusters 130 cannot be deployed; in other instances a combination of tunnel thrusters 120 and drop-down thrusters 130 (oriented transversely) can be used together to provide even greater transverse thrust. In one example, each hull 100 has one transverse thruster 120 near the bow forward of frame 4 and another near the stern aft of frame 5. In some examples a combination of drop-down thrusters and tunnel thrusters can be employed for performing various purposes (e.g., maneuvering, station-keeping, or assisting in getting underway). Various propellers, impellers, Kort nozzles, drop-down thrusters, and tunnel thrusters are available commercially, e.g., from vendors such as Lipps, Schottel, Rolls-Royce Kamewa, or Wartsila.

In one specific example, four (total) drop-down thrusters 130 are employed at about 3750 horsepower (hp) each, four (total) transverse tunnel thrusters 120 are employed at about 1000 hp each, and two (total) main propellers 110 are driven at about 5000 each, for a total of 29,000 hp (greater than 21 MW). That level of power output can counteract the effects of wind up to about 63 knots on the beam or up to about 105 knots on the bows. Other power levels and distributions among the various propulsion elements can be employed. With this or similar propulsion arrangements, the vessel can be self-sufficient, i.e., can operate without the assistance of tug vessels, with respect to docking, undocking, maneuvering in-port or at a work site, station-keeping, and transit (in both shallow and deep waters).

A set of one or more propellers 110, one or more drop-down thrusters 130, and one or more transverse thrusters 120 on each of the two hulls 100 can be interfaced in any suitable way to a guidance or positioning system. Coordinated actuation of these multiple self-propulsion sources (e.g., using a dynamic positioning system, such as a system available commercially from Kongsberg Maritime) can be employed to produce any desired motion of the vessel, e.g.: station-keeping; docking, undocking, or other fine maneuvering in harbor or at a work site; getting underway; or high-speed cruising (e.g., greater than about 15 knots, or even greater than about 20 knots). These motions can be achieved without the aid of anchors or ground tackle, and without the aid of tug vessels. The hydrodynamic shapes of the hulls 100 and columns 200 enable such high cruising speeds. The primary impediment to the vessel's motion is at the water surface 99; in a ballasted condition with submerged hulls 100, only the streamlined (i.e., foil-shaped; FIG. 14) columns 200 interact with the water surface 99, greatly reducing the hydrodynamic resistance to the vessel's passage. The influence of rough seas on the vessel, whether in transit or stationary at a work site, is also significantly reduced, enabling the vessel to work in a wider arrange of poor conditions at sea (e.g., rough seas or stormy weather).

Example 8

In the vessel of any of Examples 1-7, each hull 100 can further include one or more ballast tanks and one or more pumps to control the draft of the vessel (i.e., distance from water surface 99 to hull top). In one example arrangement, each hull 100 can include cross-connected fore and aft pump rooms (each with a dedicated sea chest), main ballast tanks near the center of each hull, and trim tanks near the bow and stern; typically there would be no cross connection between the hulls 100. The bulkheads 140 can serve to separate adjacent ballast tanks. In some instances, the ballast tanks can be arranged with a lighter displacement (in one specific example, about 12,000 tons) to maintain a draft of around 20 feet (e.g., suitable for port visits, in-harbor maneuvering, docking, or shallow-water deployment). In other instances, the ballast tanks can be arranged with heavier displacement (in the specific example, about 17,000 tons) to maintain a draft of around 40 feet (e.g., suitable for deep-water deployment or for working in a severe environment, with the greater mass providing improved stability and station-keeping). The lighter displacement can be employed for transiting open waters or open sea (i.e., a transit draft or cruising draft); in some instances an intermediate displacement resulting in a draft of around 30 feet can be suitable for transiting open waters or open sea. Pipe matrices 320, platforms 330, arches 390, boxed beams, other cross members, tower crane(s) 350, gantry(ies), or other equipment can add another 5,000 tons. Smaller draft might be employed. Each hull 100 can further include smaller trim tanks at or near its fore and aft ends and larger main ballast tanks in its main body.

Example 9

The vessel of any of Examples 1-8 can be employed for a variety of maritime applications, especially those requiring heavy-lift capabilities. Examples include but are not limited to: lifting or setting offshore oilfield drilling, production, or construction platforms on the surface; recovering condemned, wrecked, or destroyed offshore facilities on the seabed or in the water column; recovering wrecks of airplanes, ships, or submarines lost at sea. In some instances a platform cross member 330 can connect the columns 200 and hulls 100 (FIGS. 1-3, 8, 9, and 17A-17C) and can carry a tower derrick as the vessel's prime mover using a tower crane 350 (e.g., a Houseman tower derrick crane) and drill pipe 400 instead of a wire cable and block system. The working depth of such an arrangement is limited only by the availability of additional drill pipe; lifting capacity can exceed 20,000 deadweight tons using 5-inch drill pipe. The use of drill pipe 400 for lifting applications is a significant innovation and provides substantial advantages over block and cable approaches. Alternatively, arched truss gantries 390 (FIG. 10) support one or more sets of blocks and purchases that can operate at depths up to about 1000 feet (typically limited by storage capacity of the spooled wire employed). Lifting capacity typically is limited by the capacities of the blocks, tackles, spreader bars, spars, wires, cables, and winches employed. The arched truss cross members 390 can be made to bear up to 15,000 deadweight tons.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

Various systems, subsystems, components, structural elements, functional elements, or other features disclosed in the references incorporated above may be applicable to the vessels disclosed herein. The present application shall be regarded as implicitly disclosing any suitable combination of such incorporated systems, subsystems, components, or features with any of the examples explicitly disclosed herein.

In the foregoing Detailed Description, various features may be grouped together in several example embodiments for the purpose of streamlining the disclosure. This method of disclosure is not to be interpreted as reflecting an intention that any subsequently claimed embodiment requires more features than are expressly recited in the corresponding claim. Rather, inventive subject matter may lie in less than all features of a single disclosed example embodiment. Thus, any claim subsequently presented that relies upon this disclosure for support shall stand on its own as a separate disclosed embodiment. However, the present disclosure shall also be construed as implicitly disclosing any embodiment having any suitable set of one or more disclosed or claimed features (i.e., sets of features that are not incompatible or mutually exclusive) that appear in the present disclosure or the incorporated references, including those sets that may not be explicitly disclosed herein. In addition, for purposes of disclosure, each of the appended dependent claims shall be construed as if written in multiple dependent form and dependent upon all preceding claims with which it is not inconsistent.

For purposes of the present disclosure, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure, the words "comprising," "including," "having," and variants thereof, wherever they appear, shall be construed as open ended terminology, with the same meaning as if the phrase "at least" were appended after each instance thereof.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim that might subsequently rely upon this disclosure for support. The scope of subject matter encompassed by each such claim shall be determined by the recitation of only that claim.

What is claimed is:

1. A water-borne semisubmersible vessel comprising:

(a) an elongated, ballasted port hull and an elongated, ballasted starboard hull, wherein the port and starboard hulls are in a substantially parallel, spaced-apart arrangement, and wherein each one of said port and starboard hulls has an outer shell arranged with a rounded bow, a tapered stern, and a curved transverse cross-section, substantially lacks corners and edges, and thereby exhibits reduced hydrodynamic drag as the port and starboard hulls move in a forward direction through water below a surface of the water;

(b) one or more propulsion units mounted on or in one or both of the port or starboard hulls;

(c) two or more port columns connected to and supported by the port hull, wherein each one of the two or more port columns extends substantially perpendicularly upward from a top surface of the port hull, has an outer shell with a horizontal cross section that is curved, is larger in a fore-and-aft dimension than in a lateral dimension, substantially lacks corners and edges, and thereby exhibits reduced hydrodynamic drag as the port hull moves in the forward direction with the two or more port columns extending through the surface of the water;

(c') two or more starboard columns connected to and supported by the starboard hull, wherein each one of the two or more starboard columns extends substantially perpendicularly upward from a top surface of the starboard hull, has an outer shell with a horizontal cross section that is curved, is larger in a fore-and-aft dimension than in a lateral dimension, substantially lacks corners and edges, and thereby exhibits reduced hydrodynamic drag as the starboard hull moves in the forward direction with the two or more starboard columns extending through the surface of the water;

(d) a substantially horizontal platform connected to and supported by the port and starboard columns and arranged so as to hold the port and starboard hulls in the spaced-apart arrangement, wherein the vessel is arranged so that, when in the water, the port and starboard hulls are substantially submerged, the platform is above and substantially parallel to the surface of the water, and the port and starboard columns extend through the surface of the water; and (e) a lifting apparatus mounted on the platform, wherein the port and starboard hulls, the port and starboard columns, the platform, and the lifting apparatus are arranged so as to enable the lifting apparatus to lift or hoist an underwater object from below the vessel through a space between the port and starboard hulls and into a space above the surface of the water between the port columns and the starboard columns, wherein:

each one of the port and starboard columns includes one or more corresponding internal pipe matrices within the corresponding outer shell, wherein each internal pipe matrix is coupled at a lower end to a keel or a bulkhead of a corresponding one of the port or starboard hulls and at an upper end to the platform; or the platform includes one or more transversely extending pipe matrices, and each pipe matrix is coupled at a port end to one of the port columns and at a starboard end to one of the starboard columns.

2. A water-borne semisubmersible vessel comprising:

(a) an elongated, ballasted port hull and an elongated, ballasted starboard hull, wherein the port and starboard hulls are in a substantially parallel, spaced-apart arrangement, and wherein each one of said port and starboard hulls has an outer shell arranged with a rounded bow, a tapered stern, and a curved transverse cross-section, substantially lacks corners and edges, and thereby exhibits reduced hydrodynamic drag as the port and starboard hulls move in a forward direction through water below a surface of the water;

(b) one or more propulsion units mounted on or in one or both of the port or starboard hulls;

(c) two or more port columns connected to and supported by the port hull, wherein each one of the two or more port columns extends substantially perpendicularly upward from a top surface of the port hull, has an outer shell with a horizontal cross section that is curved, is larger in a fore-and-aft dimension than in a lateral dimension, substantially lacks corners and edges, and thereby exhibits reduced hydrodynamic drag as the port hull moves in the forward direction with the two or more port columns extending through the surface of the water;

(c') two or more starboard columns connected to and supported by the starboard hull, wherein each one of the two or more starboard columns extends substantially perpendicularly upward from a top surface of the starboard hull, has an outer shell with a horizontal cross section that is curved, is larger in a fore-and-aft dimension than in a lateral dimension, substantially lacks corners and edges, and thereby exhibits reduced hydrodynamic drag as the starboard hull moves in the forward direction with the two or more starboard columns extending through the surface of the water;

(d) a substantially horizontal platform connected to and supported by the port and starboard columns and arranged so as to hold the port and starboard hulls in the spaced-apart arrangement, wherein the vessel is arranged so that, when in the water, the port and starboard hulls are substantially submerged, the platform is above and substantially parallel to the surface of the water, and the port and starboard columns extend through the surface of the water; and (e) a lifting apparatus mounted on the platform, wherein the port and starboard hulls, the port and starboard columns, the platform, and the lifting apparatus are arranged so as to enable the lifting apparatus to lift or hoist an underwater object from below the vessel through a space between the port and starboard hulls and into a space above the surface of the water between the port columns and the starboard columns, wherein each one of the port and starboard columns is connected to the platform with one or more corresponding hinges arranged so as to allow the corresponding columns and attached hull to cant outward up to about 8° from vertical.

3. The vessel of claim 2 further comprising, for each one of the port and starboard columns, one or more hydraulic rams coupled to the platform and to a corresponding one of the port or starboard columns and arranged to move the corresponding one of the port or starboard columns to a desired cant angle and to hold the corresponding one of the port or starboard columns at the desired cant angle.

4. The vessel of claim 1 wherein:

each one of the port and starboard columns includes one or more corresponding internal pipe matrices within the corresponding outer shell, wherein each internal pipe matrix is coupled at a lower end to a keel or a bulkhead of a corresponding one of the port or starboard hulls and at an upper end to the platform; and the platform includes one or more transversely extending pipe matrices, and each pipe matrix is coupled at a port end to one of the port columns and at a starboard end to one of the starboard columns.

5. A water-borne semisubmersible vessel comprising:

(a) an elongated, ballasted port hull and an elongated, ballasted starboard hull, wherein the port and starboard hulls are in a substantially parallel, spaced-apart arrangement, and wherein each one of said port and starboard hulls has an outer shell arranged with a rounded bow, a tapered stern, and a curved transverse cross-section, substantially lacks corners and edges, and thereby exhibits reduced hydrodynamic drag as the port and starboard hulls move in a forward direction through water below a surface of the water;

(b) one or more propulsion units mounted on or in one or both of the port or starboard hulls;

(c) two or more port columns connected to and supported by the port hull, wherein each one of the two or more port columns extends substantially perpendicularly upward from a top surface of the port hull, has an outer shell with a horizontal cross section that is curved, is larger in a fore-and-aft dimension than in a lateral dimension, substantially lacks corners and edges, and thereby exhibits reduced hydrodynamic drag as the port hull moves in the forward direction with the two or more port columns extending through the surface of the water;

(c') two or more starboard columns connected to and supported by the starboard hull, wherein each one of the two or more starboard columns extends substantially perpendicularly upward from a top surface of the starboard hull, has an outer shell with a horizontal cross section that is curved, is larger in a fore-and-aft dimension than in a lateral dimension, substantially lacks corners and edges, and thereby exhibits reduced hydrodynamic drag as the starboard hull moves in the forward direction with the two or more starboard columns extending through the surface of the water;

(d) a substantially horizontal platform connected to and supported by the port and starboard columns and arranged so as to hold the port and starboard hulls in the spaced-apart arrangement, wherein the vessel is arranged so that, when in the water, the port and starboard hulls are substantially submerged, the platform is above and substantially parallel to the surface of the water, and the port and starboard columns extend through the surface of the water; and (e) a lifting apparatus mounted on the platform, wherein the port and starboard hulls, the port and starboard columns, the platform, and the lifting apparatus are arranged so as to enable the lifting apparatus to lift or hoist an underwater object from below the vessel through a space between the port and starboard hulls and into a space above the surface of the water between the port columns and the starboard columns, wherein the lifting apparatus comprises a tower derrick crane and a drill pipe extendable by adding additional drill pipe segments.

6. The vessel of claim 5 wherein (i) each one of the port and starboard hulls is greater than about 300 feet long and has a beam width greater than about 50 feet, (ii) the platform is greater than about 100 feet above the port and starboard hulls, (iii) the vessel is greater than about 250 feet wide, (iv) the vessel has a ballast-dependent draft between about 20 feet and about 40 feet, (v) the vessel has a lifting capacity of about 20,000 deadweight tons, (vi) the vessel has a maximum cruising speed greater than about 15 knots, (vii) the vessel can hold station against winds greater than about 50 knots on the beam and greater than about 100 knots on the bow.

7. A method employing the vessel of claim 6 comprising cruising at a speed greater than about 15 knots with the vessel draft between about 20 feet and about 30 feet.

8. A method employing the vessel of claim 6 comprising: (i) maneuvering the vessel to a position above an object in the water without employing a tug vessel, (ii) using the tower derrick crane, lowering the drill pipe into the water and down to the object, (iii) securing the drill pipe to the object, (iv) raising the object by retracting the drill pipe.

9. The method of claim 8 wherein parts (i) through (iv) are performed in seas greater than about 6 feet or in wind greater than about 30 knots.

10. The method of claim 8 wherein parts (i) through (iv) are performed during the months of November through April.

11. The method of claim 8 further comprising: (v) lifting the object out of the water by retracting the drill pipe, (vi) maneuvering a second vessel on the surface of the water between the port columns and the starboard columns beneath the object, (vii) lowering the object onto the second vessel by lowering the drill pipe, (viii) releasing the releasing the object from the drill pipe, (ix) raising the drill pipe, and (x) maneuvering the second vessel with the object out from between the port columns and the starboard columns.

12. The method of claim 11 wherein parts (i) through (x) are performed in seas greater than about 6 feet or in wind greater than about 30 knots.

13. The method of claim 11 wherein parts (i) through (x) are performed during the months of November through April.

* * * * *